US005205072A

United States Patent [19]

Eutebach

[11] Patent Number: 5,205,072

[45] Date of Patent: Apr. 27, 1993

[54] SHOWER DOOR OR DIVIDER

[75] Inventor: Peter Eutebach, Bad Salzuflen, Fed. Rep. of Germany

[73] Assignee: Dorma-Glas Gesellschaft fur Glastur-Beschlage, Bad Salzuflen, Fed. Rep. of Germany

[21] Appl. No.: 746,783

[22] Filed: Aug. 16, 1991

[30] Foreign Application Priority Data

Aug. 21, 1990 [DE] Fed. Rep. of Germany ... 9012039[U]

[51] Int. Cl.[5] ..... E05D 15/00; E05D 7/04

[52] U.S. Cl. ..... 49/381; 16/235; 16/249; 16/382

[58] Field of Search ..... 49/381; 52/207; 4/607, 4/610; 16/251, 252, 249, 235, 382

[56] References Cited

U.S. PATENT DOCUMENTS

| | | | |
|---|---|---|---|
| 4,359,802 | 11/1982 | Rock | 16/251 X |
| 4,646,491 | 3/1987 | Munch | 52/207 |
| 4,881,296 | 11/1989 | Marinomi | 16/249 X |
| 4,897,889 | 2/1990 | Baus | 4/607 |
| 4,908,908 | 3/1990 | Mitsuoka et al. | 16/251 |

FOREIGN PATENT DOCUMENTS

| | | | |
|---|---|---|---|
| 87822 | 3/1983 | European Pat. Off. | 4/607 |
| 174583 | 9/1985 | European Pat. Off. . | |
| 329137 | 2/1989 | European Pat. Off. . | |
| 2424312 | 11/1975 | Fed. Rep. of Germany . | |
| 2851722 | 6/1980 | Fed. Rep. of Germany . | |
| 3744729 | 11/1988 | Fed. Rep. of Germany . | |

*Primary Examiner*—Philip C. Kannan
*Attorney, Agent, or Firm*—Dominik, Stein, Saccocio, Reese, Colitz & Van Der Wall

[57] ABSTRACT

A shower divider to close a shower basin has at least two wall section elements made of glass or synthetic/-plastic material, which are respectively self-supporting without a frame and are articulately connected to one another by means of a hinge. At least one wall section element is equipped with a plurality of longitudinal slots arranged in superposed attitude with respect to one another but in the same plane, i.e., a plurality of parallel longitudinal slots in vertical alignment one above the other in the plane of the door, and a threaded securement screw can be operatively screwed in pre-selected manner and exchangeably into respective screw-thread holes of said hinge.

19 Claims, 3 Drawing Sheets

SHOWER DOOR OR DIVIDER

BACKGROUND OF THE INVENTION

This invention relates to a shower door or divider. More particularly, the invention is concerned with a door assembly, or divider, for a shower, comprising at least two wall section elements, which are made of glass or plastic/synthetic material, respectively supported without a frame, and articulately connected, by way of a hinge (hinge strip), in such a way that one of the wall section elements is providing a swing-type or rotating door.

The term "supported without a frame" herein is to have the meaning that a respective wall section element is self-supporting or sufficiently rigid so as not to require a frame.

In the case of such dividers, one of the wall section elements can be directly fixedly connected to the wall of the room, or at a separate fixed wall section element which, in turn, is positioned between the moveable or swingable wall section element and the wall of the room in which the shower is located.

It is known to mount the swingable wall section element for alignment or alleviation of dimensional differences such that it can be shifted, so as to compensate, amongst others, also for any dimensional tolerances of the structure as built. In this case it is also known to support the swing door in parallel manner at a wall section element so that it can be shifted. For this can be provided at least one releasable guide bar which is secured with respect to the direction of the shifting motion/movement, and which is secured at the inner side or surface and/or the outer side or surface of the respective wall section element.

Thus, it is the aim of the invention in the case of such shower dividers, to simplify the structure of the hardware, but without loss of the possibility to make adjustments for any structural dimensional differences.

SUMMARY OF THE INVENTION

In accordance with the invention in the case of a shower divider or door assembly of the type briefly discussed in the foregoing, the swingable and frame-less wall section element is equipped with longitudinal slots which are arranged in superposed attitude with respect to one another, i.e., a plurality of parallel longitudinal slots in vertical alignment one above the other in the plane of the door, and into which operatively extends a threaded securement screw, which is screwed in, to compensate for structural differences in pre-selected manner and exchangeably, into the threaded holes which are made into the hinge strip.

Such longitudinal slots allow to displace and secure the frame-less swing door, which is held by the hinge strip, in smooth, uninterrupted and continuous manner in its longitudinal direction with respect to the fixedly secured wall section element.

In a preferred embodiment in the hinge strip of the wall section element, which serves as swing door, at least two, preferably three or more, threaded holes are made into which operatively and exchangeably extends the threaded securement screw in pre-selected manner.

Such threaded holes or bores which are positioned at a distance with respect to one another and in a row, there is possible, aside from the continuous and smooth shifting of the swing door, also an increase step-wise shifting for rough alignment of structural differences.

Longitudinal slots furthermore allow precise adjustment of the swing door.

The releasable threaded securement screws respectively engage in the screw threads of the oppositely positioned hinge tab component and secure the respective wall section element in clamping manner.

In accordance with one aspect of the invention, there is provided a shower divider for a shower basin, comprising:

first and second wall section elements made of glass or synthetic/plastic material, which are self-supporting and are articulately connected to one another by means of a respective hinge, with at least one wall section element being equipped with longitudinal slots, said slots being arranged in vertical alignment with respect to one another and in the same plane;

a hinge having holes with screw-thread, for operatively connecting said first and second wall section elements; and a threaded securement screw, said threaded securement screw being adapted to operatively extend in preselected and exchangeable manner into a respective longitudinal slot and to be secured at a respective threaded hole of said hinge.

the first wall section element can be a fixed wall section element which is secured at a wall near said shower basin.

The longitudinal slots can extend parallel at a distance from one another at the height of the wall section element.

The second wall section element is preferably a swing door and said hinge can include a hinge strip operatively connected to the swing door and having at least two, preferably three or more threaded holes into which operatively extends said threaded securement screw exchangeably and in pre-selected manner.

The hinge preferably has hinge tabs which are connected to one another in articulate manner by way of an axis of rotation, and the hinge tabs are respectively two-component elements, with a flat outer hinge tab and a flat inner hinge tab, interconnected with one another by means of securement screws, and between which in length-adjustment manner are clamped the aforesaid first and second wall section elements.

The hinge can include a wall-side hinge tab which has two threaded holes into which is positioned at least one threaded securement screw.

In accordance with another aspect of the invention there is provided a cover, such as a molded strip which is secured to said hinge such as to be flush with the surface of said hinge.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF PREFERRED EMBODIMENTS

Figure 1:
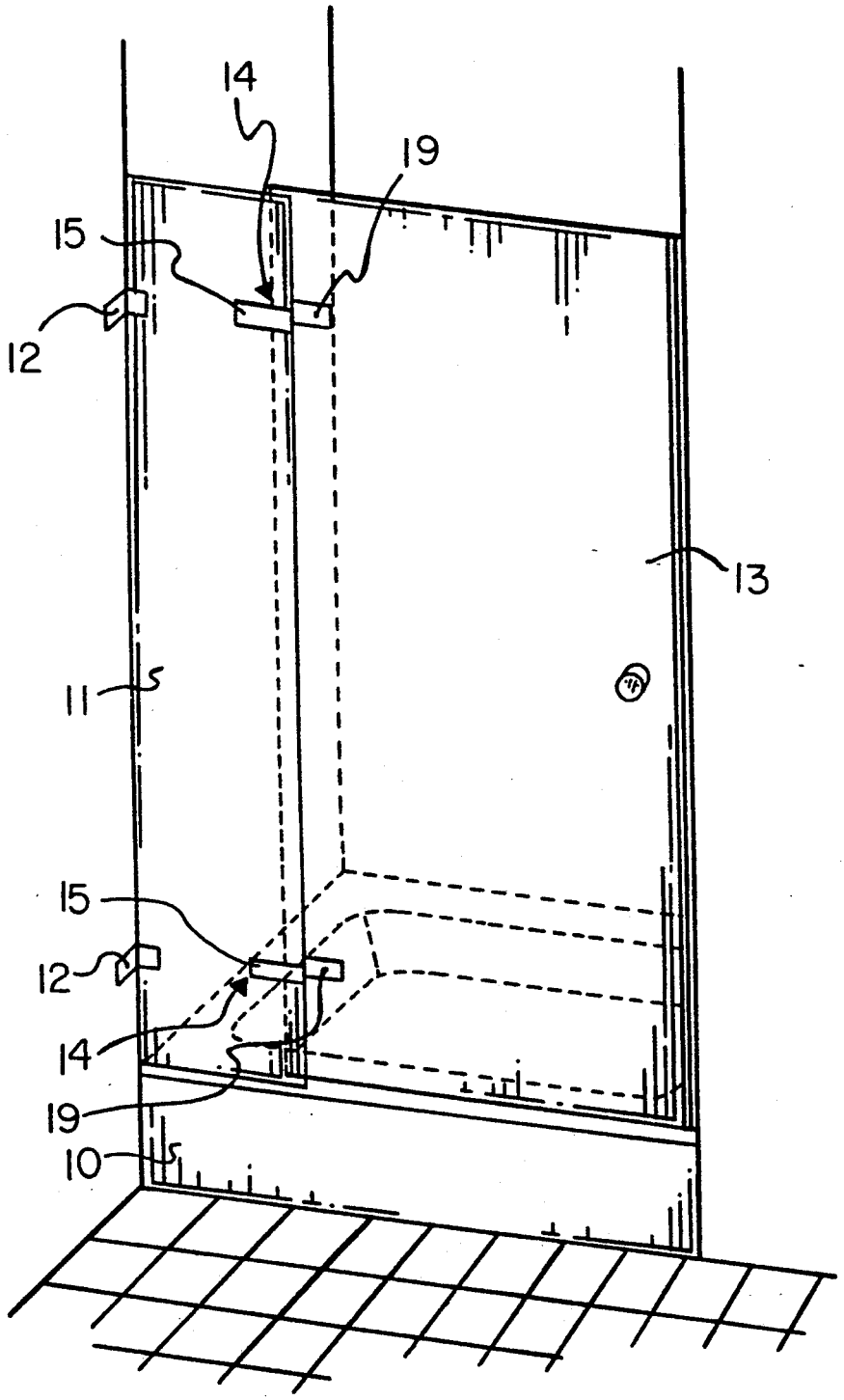
FIG. 1 is a perspective side elevational view of a shower basin with wall section elements.

With reference to FIG. 1, the shower door assembly or divider assembly comprises wall section elements, with one element being fixed to the wall and the other being hingedly or articulately connected by means of a hinge strip as folding or swing door for rotating movements at the fixed element.

Reference numeral (10) designates a shower basin which is positioned on the floor of a room.

The shower divider, or door, comprises at one side of the shower basin (10) a narrow fixedly secured wall section element (11) which is secured at the vertical wall of the room by means of hardware (12).

Next to this follows a wall section element (13) which is a frame-less or self-supporting, i.e. rigid, element or structure, made of glass or other transparent material, and is connected by way of hinge strips (14) to the fixed wall section element (11), so as to serve as the swing door. Several hinge strips (14) are distributed over the height of the fixed wall section element (11), for positive securement of the swing door (13) at the fixed wall section element (11).

This embodiment includes an outer hinge tab (15) of the hinge strip (14) which has two threaded holes or bores (16*a*, 16*b*). Correspondingly threaded screws (17) are used to secure the hinge tab (15) in clamping manner at the fixed wall section element (11).

The hinge strip (14) also has an inner hinge tab (18) with two threaded bores (16*c*) which respectively receive the head of threaded screw (17), two being used in this embodiment. The threaded screws (17) can be fixed in bores (11*a*, 11*b*) of the wall section element (11) which have corresponding screw threads, so that the respective components can not shift, and such that the hinge strip (14) is clamped to wall section element (11) in such a way that the respective positions do not change.

About the axis of rotation (28) of this hinge tab (14), which may be a worked-in element or structure, rotates a further, outer, hinge tab (19), which is equipped, for example, with three threaded bores or holes (20*a*, 20*b*, 20*c*), into which selectively can extend a removable securement screw (21) which is correspondingly provided with screw threads.

Figure 4:
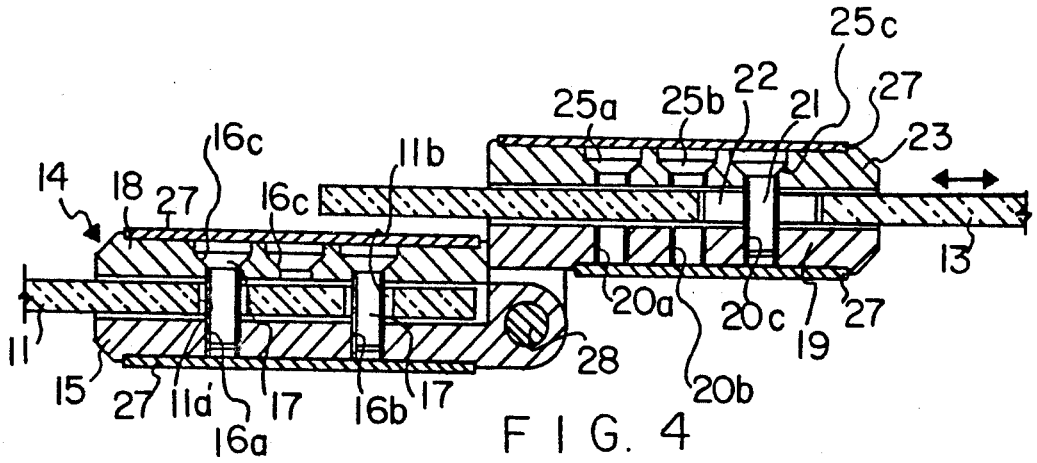
FIG. 4 is a horizontal cross section taken along line IV—IV in FIG. 2.

In the embodiment according to FIG. 4, the securement screw (21), in the case of a lengthier or extended wall section element (13), reaches into the outer or forward bore (20*c*).

Figure 5:
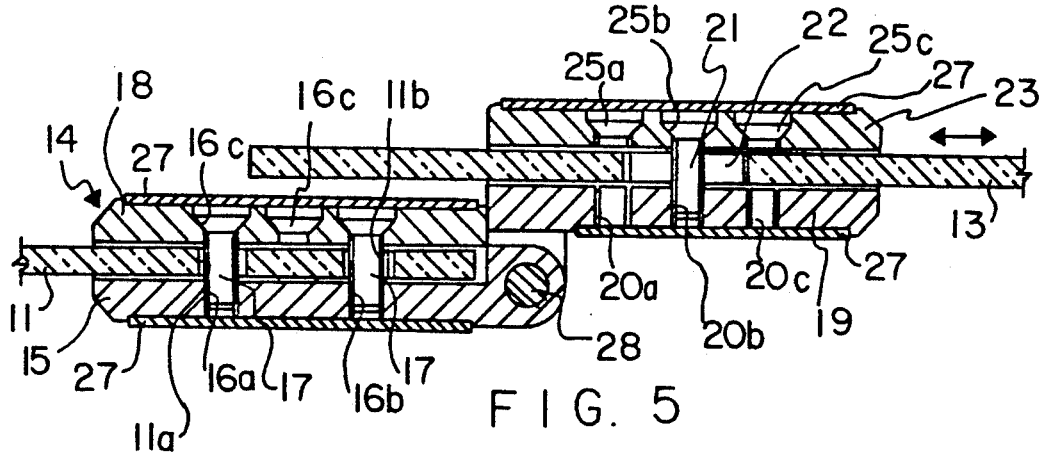
FIGS. 5 and 6 are, respectively, horizontal cross-sections similar to FIG. 4 and which serve to show swing door elements which are clamped at different lengths.

According to FIG. 5, the securement screw (21) extends into the central hole or bore (20*b*).

Figure 6:
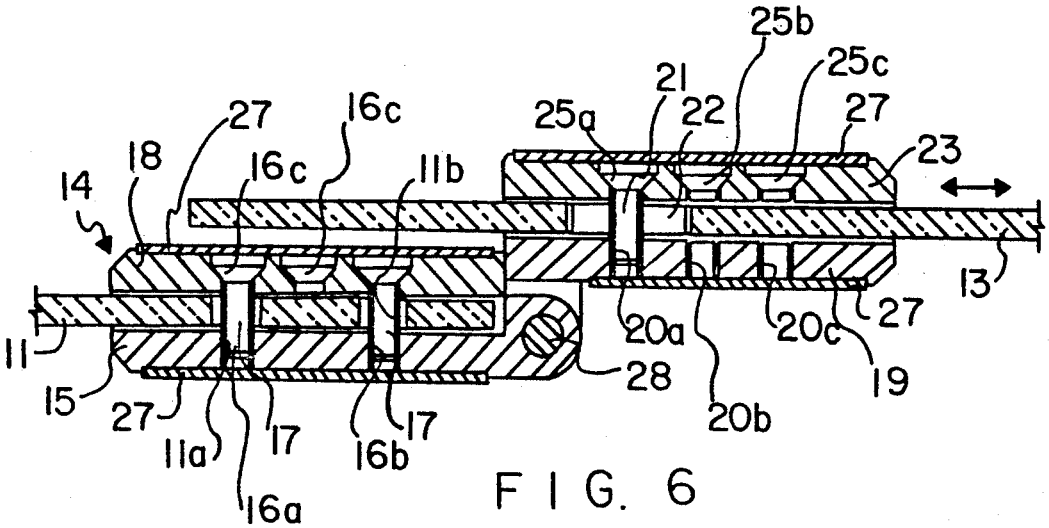

According to FIG. 6, the securement screw (21) extends into the inner or rearward bore (20*a*).

The securement screw (21) extends respectively through a longitudinal slot (22) of the swingable pane of glass of wall section element (13).

Since the longitudinal slot (22) extends in the region of the forward threaded hole or bore (20*c*), only a short portion of the pane of glass is secured in clamped manner in the embodiment according to FIG. 4.

In the embodiment according to FIG. 6, however, a considerable extent of the pane of glass is clamped, since the longitudinal slot (22) is positioned in the region of the inner screw bore or hole (20*a*). The free or available surface of the swing door (13) is accordingly reduced in area.

An inner, transparent hinge tab (23) serves as abutment plate for the swingable hinge tab (19). Tab (23) has three bores (25*a*, 25*b*, 25*c*) which receive, respectively interchangeably and selectively, the head of the securement screw (21) and are in registry with the three threaded bores or holes (20*a*, 20*b*, 20*c*) which, in turn, are serially positioned along one another (see FIG. 2), at the front surface of the hinge tab (19-lateral outer part).

Figure 2:
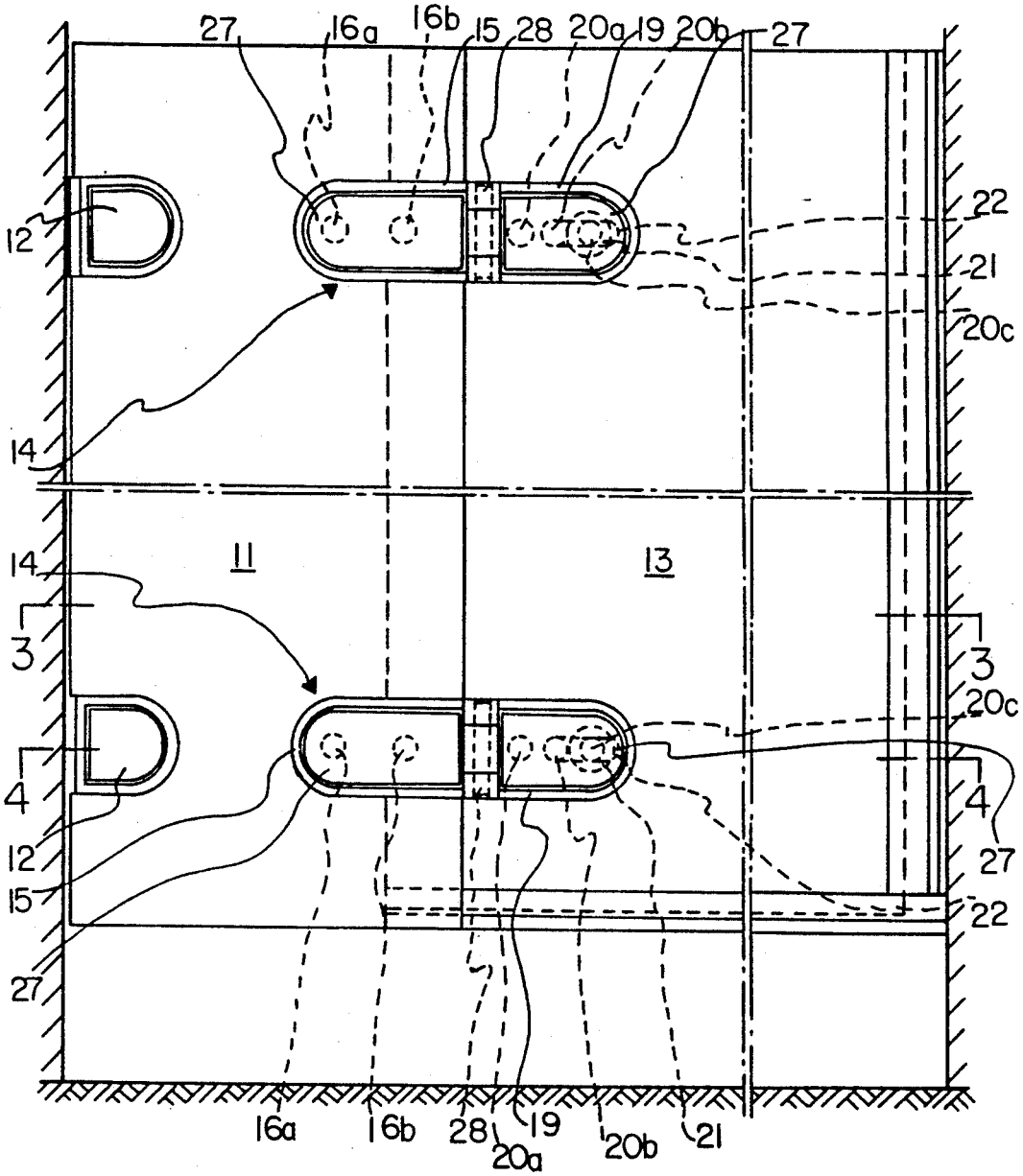
FIG. 2 is a side elevation of the same elements of FIG. 1 on a shower basin.
Figure 3:
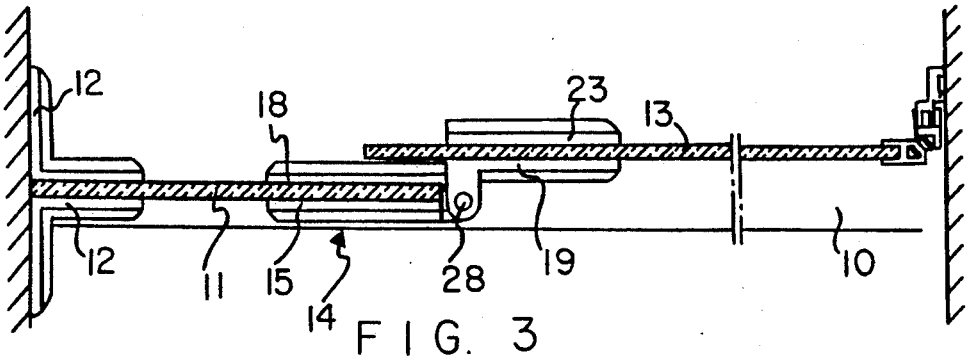
FIG. 3 is a horizontal cross section taken along line III—III in FIG. 2 through the wall section elements with a hinge strip.

With reference to FIG. 2, at the hinge-side edge, in the peripheral region of the swing door or frame-less wall section element (13) are provided, as a material part of the invention, one above the other but in the same plane, the several longitudinal slots (22) for the swing door (13), which provide the opportunity, on the one hand when the securement screw (21) has been mounted, to move the hinge tabs (19 and 23) with respect to one another in infinitely variable manner. Thus, the glass pane can be adjusted to accommodate smaller differences in distances of length. As can be readily seen in FIG. 2, swing door (13) contains a plurality, two, of parallel longitudinal slots (22) in vertical alignment one above the other in the plane of the door (13).

The hinge tabs (15, 18, 19, 23) are preferably covered by a shield, such as moulding elements or strips (27) which protect, respectively, the tabs and the threaded bores (16 and 20) to the exterior. These moldings (27) form, on the one hand, sight covers or louvres and preclude, on the other hand, the ingress of dirt into the threaded holes (16, 20, 25) and the longitudinal slots (22) respectively.

The two hinge tabs (15, 19) which are connected to one another by way of the axis of rotation (28) are—as shown in the preceding embodiment—respectively two-component parts and in particular respectively between an outer flat hinge tab (15, 19) and a flat inner hinge tab (18, 23) receive between them the wall section elements (11 and 13, respectively), such that these can be clamped to one another by means of threaded securement screws (17, 21), or the like in different positions.

Thus, the invention relates to a shower divider, or door, for a shower basin with at least two wall section elements (11, 13) made of glass or synthetic/plastic material.

The wall section elements (11, 13) are respectively supported without a frame and are articulately connected to one another by means of at least one hinge (14), usually two hinges (14).

Each hinge (14) includes at least two hinge elements (15, 19) connected to one another by way of an axis of rotation (28). The individual hinge elements (15, 19) are connected by means of at least one screw (21), which extends through the respective wall section element (11, 13), with the respective wall element section element (11, 13).

For securement of the screw (21), each of the hinge elements (15, 19) has several threaded holes (20).

In the shown embodiment, the hinge element (19) has three such threaded holes or bores (20*a*, 20*b*, 20*c*) which are spaced at a distance with respect to one another and horizontally adja-cent to one another.

Since in accordance with the invention the wall section element is equipped with a horizontal longitudinal slot (22), it is possible to shift the wall section element, upon loosening of the screw (21) in horizontal direction, over the full length of the slot (22), in order to attain in this manner a precise adjustment of the horizontal alignment of the wall section element.

In the event the adjustment afforded by the length of the slot (22) is not sufficient, the screw (21) can be introduced into another one of the group of three threaded holes.

The invention accordingly offers the possibility to precisely adjust and position the wall section elements in the horizontal direction.

The embodiment shown in the drawing figures includes two hinges (14), from which results that in the region of each hinge a corresponding longitudinal slot (22) is provided in the wall section element.

Instead of separate hinges, as shown in FIGS. 1 and 2, in accordance with the invention, one can also use a continuous hinge strip.

It is also possible that several horizontally disposed longitudinal slots (22) and associated screws (21) are used; for example, in the case of separate hinges, as shown in FIGS. 1 and 2, respectively one above the other arranged, to achieve a doubled embodiment of the longitudinal slots and screws to increase the mechanical stability.

Without further analysis, the foregoing will so fully reveal the gist of the present invention that others can, by applying current knowledge, readily adapt it for various applications without omitting features that, from the standpoint of prior art fairly constitute essential characteristics of the generic or specific aspects of this invention.

What is claimed as new and desired to be protected by Letters Patent is set forth in the appended claims:

1. A shower divider for a shower basin, comprising at least two wall section elements made of glass or synthetic/plastic material, which are respectively supported without a frame and are articulately connected to one another by means of hinges, wherein the improvement comprises that at least one wall section element is equipped with a plurality of longitudinal slots, said slots being arranged in vertical alignment with respect to one another but in the same plane, and threaded securement screws which are operatively screwed in pre-selected manner and exchangeably into respective screw-thread holes of said hinges to mount said hinges to said wall section elements.

2. The shower divider according to claim 1, wherein each said hinge is a hinge strip.

3. A shower divider for a shower basin, comprising:

first and second wall section elements made of glass or synthetic/plastic material, which are self-supporting and are articulately connected to one another by means of respective hinges, with at least one wall section element being equipped with longitudinal slots, said slots being arranged in vertical alignment with respect to one another and in the same plane;

hinges having holes with screw-thread, for operatively connecting said first and second wall section elements; and threaded securement screws, each said threaded securement screw being adapted to operatively extend in preselected and exchangeable manner into a respective longitudinal slot and to be secured at a respective threaded hole of said hinges to mount each said hinge to a said wall section element.

4. The shower divider according to claim 3, wherein said first wall section element is a fixed wall section element secured at a wall near said shower basin.

5. The shower divider according to claim 3, wherein said second wall section element is a swing door and wherein each said hinge includes a hinge strip operatively connected to the swing door and having at least two, preferably three or more, threaded holes into which operatively extends said threaded securement screw exchangeably and in pre-selected manner.

6. The shower divider according to claim 3, wherein each said hinge has hinge tabs which are connected to one another in articulately manner by way of an axis of rotation.

7. The shower divider according to claim 6, wherein said hinge tabs are respectively two-component elements.

8. The shower divider according to claim 7, with flat outer hinge tabs and flat inner hinge tabs, interconnected with one another by means of securement screws, and between which in length-adjustment manner are clamped said first and second wall section elements.

9. The shower divider according to claim 3, wherein each said hinge includes a wall-side hinge tab which has two threaded holes into which is positioned at least one threaded securement screw.

10. The shower divider according to claim 3, and further comprising a cover for respective threaded holes.

11. The shower divider according to claim 10, wherein said cover is a molded strip.

12. The shower divider according to claim 11, wherein said molded strip is secured to said hinge.

13. The shower divider according to claim 11, wherein said molded strip is flush with the surface of said hinge.

14. A shower divider for a shower basin with at least two wall section elements made of glass or synthetic/plastic material, which are respectively supported without a frame and are articulately connected to one another by means of at least one hinge, whereby the hinge includes at least two hinge elements connected to one another by way of an axis of rotation, and which by means of a screw, which can be introduced into a screw-threaded hole of the hinge element, is connected with the respective wall element section, characterized thereby that at least one wall section element is equipped with at least one horizontal slot through which can be passed the screw.

15. Shower divider according to claim 14, characterized thereby that several hinges are provided, the hinge elements of which are respectively by means of a single screw connected with the wall element section, and that in the wall element section are provided several longitudinal slots which extend parallel with respect to one another.

16. Shower divider according to claim 14, characterized thereby that hinge element is provided with several horizontally spaced threaded holes whereby the screw selectively can be introduced into one of the threaded holes.

17. Shower divider according to claim 14, characterized thereby that the hinge element includes a hinge plate which is arranged on that side of the wall section element which is disposed oppositely with respect to the hinge element and which is secured by means of screws to the hinge element.

18. Shower divider according to claim 14, characterized thereby that one wall section element is a fixed wall section element, and that the other wall section element is the door of the shower divider.

19. Shower divider according to claim 14, characterized thereby that each hinge is shielded by a cover.

* * * * *